US010822153B2

(12) United States Patent
Wilmers et al.

(10) Patent No.: US 10,822,153 B2
(45) Date of Patent: Nov. 3, 2020

(54) VISIBLE LIGHT BARRIER FOR DAIRY PACKAGING

(71) Applicant: Nestec S.A., Vevey (CH)

(72) Inventors: Kimberly Ann Wilmers, Twin Lakes, MI (US); Valerie Geiser, Lausanne (CH)

(73) Assignee: Societe des Produits Nestle S.A., Vevey (CH)

( * ) Notice: Subject to any disclaimer, the term of this patent is extended or adjusted under 35 U.S.C. 154(b) by 83 days.

(21) Appl. No.: 16/295,775

(22) Filed: Mar. 7, 2019

(65) Prior Publication Data

US 2019/0202620 A1 Jul. 4, 2019

Related U.S. Application Data

(62) Division of application No. 15/057,323, filed on Mar. 1, 2016, now abandoned.

(60) Provisional application No. 62/127,192, filed on Mar. 2, 2015.

(51) Int. Cl.

| | |
|---|---|
| ***B65D 85/84*** | (2006.01) |
| ***B65D 81/30*** | (2006.01) |
| ***B65D 25/54*** | (2006.01) |
| ***B65D 25/14*** | (2006.01) |
| ***B65D 85/72*** | (2006.01) |

(52) U.S. Cl.

CPC ..... *B65D 81/30* (2013.01); *B65D 25/14* (2013.01); *B65D 25/54* (2013.01); *B65D 85/72* (2013.01)

(58) Field of Classification Search

CPC ..... B65D 25/14; B65D 25/54; B65D 81/30; B65D 85/72

USPC ..... 206/524.3, 775–778, 782; 426/106, 119, 426/120, 130, 392

See application file for complete search history.

(56) References Cited

U.S. PATENT DOCUMENTS 5,503,902 A 4/1996 Steenblik
6,026,956 A * 2/2000 Jensen ..... B65D 5/56 206/459.1

(Continued)

FOREIGN PATENT DOCUMENTS

CN 1532121 A 9/2004
CN 203344407 U 12/2013

(Continued)

OTHER PUBLICATIONS

International Search Report and Written Opinion dated Apr. 19, 2016 received in corresponding PCT Application No. PCT/IB2016/051127.

(Continued)

*Primary Examiner* — Luan K Bui
(74) *Attorney, Agent, or Firm* — K&L Gates LLP

(57) ABSTRACT

A package system having a body is described. The body has a bottom wall, at least one side wall, and a top wall cooperating with one another to define an interior compartment for housing a consumable product. At least one of the bottom wall, side wall or top wall includes a viewing portion having a light barrier configured to block wavelengths of visible light from below a baseline wavelength and above a top-line wavelength and pass visible light between the baseline wavelength and the top-line wavelength so as to allow the consumable product to be viewed through the viewing portion of the body.

20 Claims, 7 Drawing Sheets

(56) References Cited

U.S. PATENT DOCUMENTS

| | | | | |
|---|---|---|---|---|
| 6,062,391 | A * | 5/2000 | Nahum-Albright | B65D 5/4204 206/457 |
| 6,936,735 | B2 | 8/2005 | Chaudhuri | |
| 6,943,231 | B2 | 9/2005 | Buhler | |
| 7,097,789 | B2 | 8/2006 | Connor | |
| 7,521,006 | B2 | 4/2009 | Ikeda | |
| 7,544,405 | B2 | 6/2009 | Lepage | |
| 8,003,082 | B2 | 8/2011 | Chaudhuri | |
| 8,053,159 | B2 | 11/2011 | Li | |
| 8,318,226 | B2 | 11/2012 | Hara | |
| 2003/0189061 | A1 * | 10/2003 | Kawai | B65D 1/0215 222/1 |
| 2004/0005419 | A1 * | 1/2004 | McGrath | B65D 81/30 428/35.7 |
| 2006/0046006 | A1 | 3/2006 | Bastion | |
| 2006/0051586 | A1 | 3/2006 | Park | |
| 2006/0177607 | A1 | 8/2006 | Ohmori | |
| 2007/0100033 | A1 | 5/2007 | Schambondy | |
| 2007/0293666 | A1 | 12/2007 | Minami | |
| 2008/0044540 | A1 | 2/2008 | Kido | |
| 2009/0098250 | A1 | 4/2009 | Py | |
| 2010/0264059 | A1 * | 10/2010 | Jacob Cestari | B65D 5/4204 206/778 |
| 2011/0100857 | A1 * | 5/2011 | Wang | B65D 81/30 206/524.1 |
| 2012/0082834 | A1 | 4/2012 | Wermter | |
| 2012/0027809 | A1 | 9/2012 | Bharti | |
| 2013/0022714 | A1 * | 1/2013 | Coderre | B65D 33/14 426/106 |
| 2013/0059924 | A1 | 3/2013 | Scheurich | |
| 2013/0064934 | A1 * | 3/2013 | Vogt | B65D 75/5833 426/106 |
| 2014/0121324 | A1 | 5/2014 | Boutrid | |
| 2014/0374416 | A1 * | 12/2014 | Tom | B29C 49/783 220/62.21 |
| 2019/0282444 | A1 * | 9/2019 | Terhune | B65D 25/54 |

FOREIGN PATENT DOCUMENTS

| | | | |
|---|---|---|---|
| EP | 1953575 | | 8/2008 |
| EP | 1964790 | | 9/2008 |
| EP | 2319811 | | 5/2011 |
| GB | 1364532 | A | 8/1974 |
| JP | H10129740 | A | 5/1998 |
| WO | 1998030390 | | 7/1998 |
| WO | 0132514 | | 5/2001 |
| WO | 2001077215 | | 10/2001 |
| WO | 2003007906 | | 1/2003 |
| WO | 200892643 | | 11/2003 |
| WO | 2005047265 | | 5/2005 |
| WO | 200810501 | | 1/2008 |
| WO | 2011054839 | | 5/2011 |
| WO | 2012017984 | | 2/2012 |

OTHER PUBLICATIONS

Cheng, Hefa, "Volatile Flavor Compounds in Yogurt: A Review," Critical Reviews in Food Science and Nutrition, vol. 50, pp. 938-960. Nov. 24, 2010.

* cited by examiner 64 66

| Filter | Spectral Profiles | Approximate % Transmission Below Baseline Wavelength | Approximate % Transmission Above Top Line Wavelength | Approximate % Light Transmission Total Visible Light Spectrum |
|---|---|---|---|---|
| Cosmetic Rouge |  | 45%-50% | 47%-70% | 58.8% |
| Heavy Frost |  | 2%-5% | 2%-5% | 25% |
| Deep Strawberry |  | 0%-68% | 78%-90% | 60.8% |
| Light Blue |  | 20%-78% | 0%-20% | 22.2% |
| Orange |  | 0%-22% | 25%-85% | 41.3% |
| Lavender |  | 0%-60% | 0%-85% | 8.9% |

VISIBLE LIGHT BARRIER FOR DAIRY PACKAGING

CROSS REFERENCE TO RELATED APPLICATIONS/INCORPORATION BY REFERENCE STATEMENT

The subject application is a divisional of U.S. Ser. No. 15/057,323, filed Mar. 1, 2016, now abandoned; which claims benefit under 35 USC § 119(e) of provisional application U.S. Ser. No. 62/127,192, filed Mar. 2, 2015. The entire contents of each of the above-referenced applications are expressly incorporated herein by reference.

STATEMENT REGARDING FEDERALLY SPONSORED RESEARCH AND DEVELOPMENT

Not Applicable.

BACKGROUND

More than ninety volatile compounds, including carbohydrates, alcohol, aldehydes, ketones, acids, esters, lactones, sulfur-containing compounds pyrazines, and furan derivative are within yogurt. These compounds may be present in small (mg/kg) or trace (μg/kg) concentrations. The balance of the ratios of compounds, however, has been determined to be important for the quality and taste of the yogurt. Off-flavor yogurt may be due to the breakdown of lactose, to free fatty acids, and/or the heavier alcohol balance within the yogurt, for example.

Light abused yogurt and milk may disrupt the balance of the ratios of compounds and/or lead to off-flavor taste. For example, several sulfur-containing compounds have been identified in light abused milk including mercapto compounds, mercaptans, and sulfides. Riboflavin, protein and oxygen also appear to affect flavor. Off-flavors in light-abused dairy products have been characterized as sulphur-like and tasting of burnt cabbage, mushroom, papery, cardboard, metallic, tallowy, or oily.

Photosensitivity for dairy products, such as yogurt, has been documented within the prior art. Riboflavin has been thought to play a role in the photodegradation as riboflavin is able to absorb visible and UV light, and transfer the energy into a highly reactive form of singlet oxygen. This may induce a series of oxidation reactions resulting in sulfur-containing byproducts.

Currently within the prior art, the consensus is that to preserve organoleptic quality of dairy products, the dairy products should be protected from all visible light. In particular, wavelengths between 415 and 455 nm should be minimized and visible light within these wavelengths may be responsible for light-induced off-flavor dairy products. With regard to yogurt products, the current art uses a non-translucent white package to block all visible light to assist in maintaining the quality of the yogurt for months.

Product presentation within stores, however, is vital to the marketing and selling of a product line. Manufacturers spend time designing a product's appearance for customer appeal. As such, product marketing and displays may benefit from packaging that protects the dairy product, such as yogurt, from visible light, yet provides visibility of the interior of the package. For example, it may be beneficial for a customer to be able to see within the packaging fruit layers, swirls, granola, nuts, seeds, spices, and the like, mixed with the dairy product.

Therefore, there is a need in the art for new and improved package systems that maintain the integrity of dairy products while providing visibility to the interior of the container. It is to such systems, compositions used therein, and kits containing same, along with a range of products for use in the systems, as well as methods of making and using same, that the presently disclosed inventive concept(s) are directed.

BRIEF DESCRIPTION OF THE DRAWINGS

Like reference numerals in the figures represent and refer to the same of similar element or function. Implementations of the disclosure may be better understood when consideration is given to the following detailed description thereof. Such description makes reference to the annexed pictorial illustrations, schematics, and drawings.

DETAILED DESCRIPTION

Figure 1A:
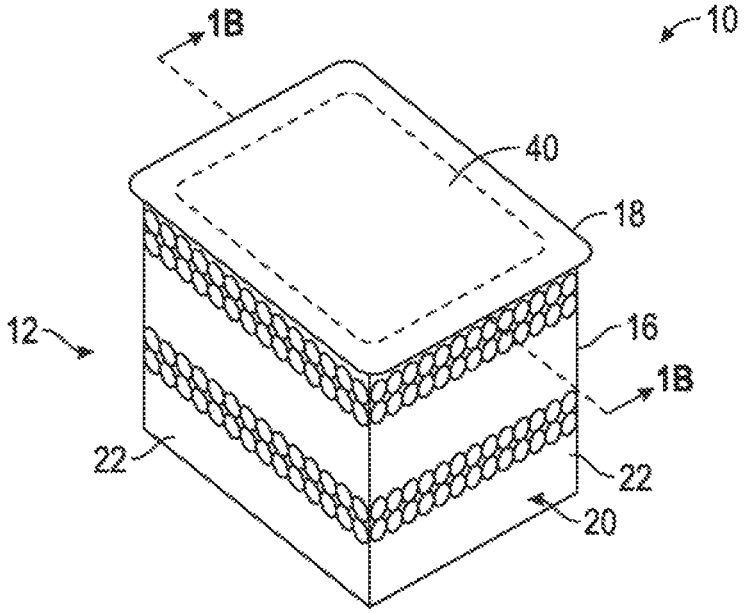
FIG. 1A is a perspective view of an exemplary embodiment of a package system constructed in accordance with the present disclosure.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more of the features of the embodiments described herein.

Figure 1B:
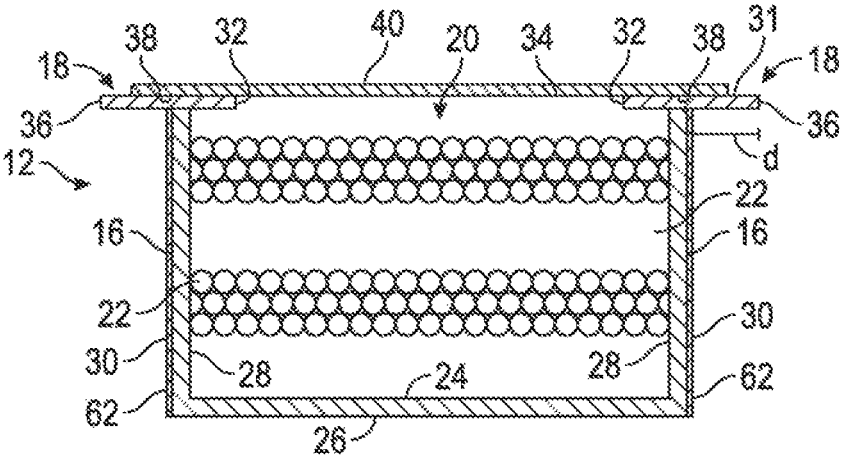
FIG. 1B is a cross sectional view of the package system illustrated in FIG. 1A taken along line 1B-1B and illustrating a coating layer adjacent to a side wall of the package system.

Referring now to the drawings and more particularly to FIGS. 1A and 1B, illustrated therein is an exemplary embodiment of a package system 10 constructed in accordance with the present disclosure. The package system 10 includes a body 12 having a bottom wall 14, one or more side walls 16, and a top wall 18 cooperating with one another to define an interior compartment 20 for housing consumable product 22, such as a dairy product (a food produced from the milk of mammals, e.g., yogurt, cheese, and cottage cheese), for example. Generally, one or more portions of the body 12 may be configured to minimize wavelengths of visible light passing into the interior compartment 20, while allowing for the consumable product 22 within the interior compartment 20 of the body 12 to be seen from outside of the package system 10 as discussed in further detail herein. Also, it should be noted that the consumable product 22 can be a multi-layered yogurt having one or more layers of a non-yogurt product, such as fruit-based product, granola, cereal, nuts, seeds, spices, or the like are placed between layers of yogurt. By way of example, the bands with circles in the FIGS. 1A, 1B, 2A, 3, 4A and 5 denote the layers of fruits, granola or the like, and the bands without circles denote yogurt.

In one embodiment, the dairy product is a food produced from the milk of mammals.

In a further embodiment, the dairy product includes a food produced from the milk of mammals, and traditionally a non-dairy product that can benefit from the packaging.

In a further embodiment, the consumable product is traditionally a non-dairy product that can benefit from the packaging.

In another embodiment, the consumable product is shelf-stable.

Referring to FIGS. 1A and 1B, the bottom wall 14 has an interior surface 24 and an exterior surface 26, with the interior surface 24 adjacent to and in contact with the consumable product 22 within the interior compartment 20. Similarly, each side wall 16 has an interior surface 28 and an exterior surface 30, with the interior surface 28 adjacent to and in contact with the consumable product 22 within the interior compartment 20.

In some embodiments, the one or more side walls 16 may be oriented relative to the bottom wall 14 at an angle of about 90 degrees as illustrated in FIGS. 1A and 1B. Alternatively, one or more side walls 16 may be oriented relative to the bottom wall 14 at an angle greater than 90 degrees as shown in package system 10*a* of FIG. 2A, or at an angle less than 90 degrees as shown in package system 10*b* of FIG. 3.

Although four side walls 16 are illustrated in FIG. 1A, any number of side walls 16 greater than four or less than four may be used to cooperate with the bottom wall 14 and the top wall 18 to define the interior compartment 20 for housing the consumable product 22. For example, the body 12 could have one side wall 16 in the form of a circle or an ellipse, or eight sidewalls 16 in the form of an octagon. More particularly, in some embodiments, the one side wall 16 may cooperate with the bottom wall 14 and the top wall 18 to define the interior compartment 20 for housing the consumable product 22. For example, in the package system 10*c* illustrated in FIG. 4A, the package system 10*c* has a body 12*c* with a bottom wall 14*c*, and a single side wall 16*c* in the form of a circle, and oriented relative to a bottom wall 14*c* at an angle greater than 90 degrees. The body 12*c* also includes a top wall 18*c* that cooperates with the side wall 16*c* and the bottom wall 14*c* to define an interior compartment 20*c* for housing the consumable product 22, such as a yogurt product. The package systems 10, 10*a*, 10*b* and 10*c* are similar in construction and function, except as described herein. For this reason, the package system 10 will be described in detail hereinafter. It should be understood, however, that the discussion of how to make and use the package system 10 is equally applicable to the package systems 10*a*, 10*b* and 10*c*.

In some embodiments, the bottom wall 14, the side wall(s) 16, and/or the top wall 18 may be formed of an organic, synthetic and/or processed material. For example, in some embodiments, the bottom wall 14, the side wall(s) 16, and/or the top wall 18 may be formed of a synthetic material made from an organic polymer such as polyethylene, and/or the like. In some embodiments, the bottom wall 14, the side wall(s) 16, and/or the top wall 18 may be formed of material capable of being molded into a predetermined shape while soft and then set into a rigid and/or slightly elastic formation. In some embodiments, portions of, or the entire bottom wall 14, side wall(s) 16, and/or top wall 18 may be formed of semi-transparent, transparent and/or translucent material.

The top wall 18 may provide access to the interior compartment 20 of the package system 10. Referring again to FIGS. 1A and 1B, in some embodiments, the top wall 18 may include a non-mechanical connection to provide access to the interior compartment 20 defined by the body 12 of the package system 10. For example, the top wall 18 may include a lip 31 connected to an upper end of the one of more sidewall 16. The lip 31 may have a first edge 32 defining an opening 34 within the top wall 18 and a second edge 36 extending a distance d over the side wall(s) 16. The top wall 18 may also include at least one removable layer 40. In this instance, the lip 31 may have a sealing surface 38 for attaching and supporting the at least one removable layer 40. The removable layer 40 may be configured to extend over and encompass the opening 34, and be removable connected to the sealing surface 38 of the lip 31 so as to seal the opening 34 defined within the top wall 18 by the first edge 32 of the lip 31. For example, the removable layer 40 may be formed of a flexible strip of plastic, metal (e.g., foil), and/or the like. In some embodiments, the removable layer 40 may be a one-time-use layer. For example, in some embodiments, the removable layer 40 may attached to the sealing surface 38 via adhesive, cohesive and/or the like. Once the entire removable layer 40, or a portion of the removable layer 40, is removed from the sealing surface 38, access to the interior compartment 20 of the package system 10 may be provided, and the removable layer 40, or portions of the removable layer 40, may be discarded.

In some embodiments, the entire top wall 18 or portions of the top wall 18 (such as the removable layer 40) may be removed to provide access to the interior compartment 20 of the body 12 of the package system 10 so that a user can access the consumable product 22. The top wall 18 or portions of the top wall 18 may be configured to be of one-time-use and discarded after removal.

Figure 5:
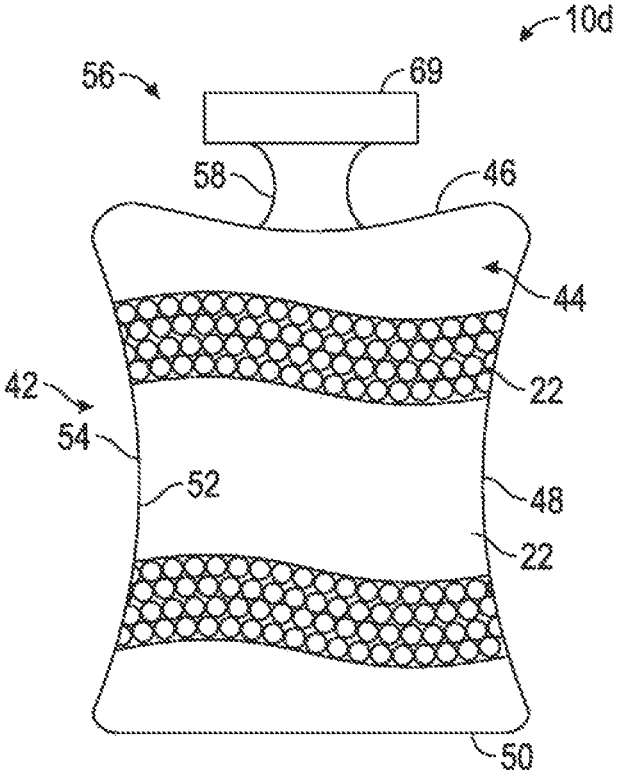
FIG. 5 is a side view of another exemplary embodiment of a package system in accordance with the present disclosure.

FIG. 5 illustrates an exemplary embodiment of a package system 10*d* having a pouch body 42 defining an interior compartment 44 for housing the consumable product 22. The pouch body 42 includes a top wall 46, one or more side walls 48 and a bottom wall 50 cooperating to surround and thereby form the interior compartment 44 for housing the consumable product 22. In some embodiments, the pouch body 42 may be formed of flexible material.

Each side wall 48 of the pouch body 42 includes an interior surface 52 and an exterior surface 54 with the interior surface 52 adjacent to and in contact with the consumable product 22. The package system 10*d* may include an opening device 56 connected to at least one of the top wall 46, the sidewall(s) 48 and/or the bottom wall 50 for providing access to the consumable product 22. The opening device 56, for example, may include a tubular projection 58 with a cap 60 for containing the consumable product 22 within the pouch body 42. It should be appreciated that other opening devices 56 may be used, as the opening device 56 is not limited to the tubular projection 58 and cap 60 illustrated herein. Although FIG. 5 shows the tubular projection 58 connected to the top wall 46, it should be understood that the presently disclosed inventive concepts are not limited to the tubular projection 58 being position at the top wall 46. As discussed above, the tubular projection 58 may be positioned at any other portion of the pouch body 42 including one or more side walls 48 or at the bottom wall 50.

As discussed above, light degradation may affect the organoleptic properties, as well as the integrity of the consumable product 22. As such, each package system 10, 10*a*, 10*b*, 10*c* and 10*d* illustrated in FIGS. 1-5 may provide visible and/or UV light barrier protection within predetermined bands of the visible light spectrum for protecting the consumable product 22 from light within the visible light spectrum that may react with volatile compounds within the consumable product 22. In some embodiments, each package system 10, 10*a*, 10*b*, 10*c* and 10*d* may provide visible and/or UV light barrier protection for consumable products 22. In particular, one or more portions of the body 12 or pouch body 42 illustrated in FIGS. 1-5 may include a light barrier configured to minimize a passage of predetermined bands of wavelengths of visible light and/or UV light to the interior compartment 20 of the body 12 or the interior compartment 44 of the pouch body 42, while allowing for other predetermined bands to pass through the body 12 or pouch body 42 to allow the consumable product 22 within the interior compartment 20 or 44 to be seen from outside of the package system 10, 10*a*, 10*b*, 10*c* or 10*d* (i.e., seen from an exterior of the package system 10, 10*a*, 10*b*, 10*c* or 10*d*).

The visible light spectrum has a spectral range encompassing wavelengths of electromagnetic energy in a range between 780 nm to 390 nm. Electromagnetic energy having wavelengths in the range between 780 nm to 390 nm is referred to herein as visible light.

In some embodiments, the light barrier may be configured as a band pass filter having a pass band allowing passage of predetermined wavelengths of visible light that are not harmful to the consumable product 20, while minimizing passage of wavelengths of visible light that are harmful to the consumable product 20. The passage of predetermined wavelengths of visible light that are not harmful to the consumable product 20 allows the consumable product 22 within the interior compartment 20 to be viewed from outside of the package system 10, 10*a*, 10*b*, 10*c* or 10*d* by prospective purchasers, for example.

The light barrier may minimize and/or block wavelengths of visible light on the lower end of the visible spectrum range between 400 nm to 550 nm, with the baseline wavelength set at a level equal to or less than 550 such as 400 nm, 401 nm, 402 nm, 403 nm, 404 nm, 405 nm, 406 nm, 407 nm, 408 nm, 409 nm, 410 nm, 411 nm, 412 nm, 413 nm, 414 nm, 415 nm, 416 nm, 417 nm, 418 nm, 419 nm, 420 nm, 421 nm, 422 nm, 423 nm, 424 nm, 425 nm, 426 nm, 427 nm, 428 nm, 429 nm, 430 nm, 431 nm, 432 nm, 433 nm, 434 nm, 435 nm, 436 nm, 437 nm, 438 nm, 439 nm, 440 nm, 441 nm, 442 nm, 443 nm, 444 nm, 445 nm, 446 nm, 447 nm, 448 nm, 449 nm, 450 nm, 451 nm, 452 nm, 453 nm, 454 nm, 455 nm, 456 nm, 457 nm, 458 nm, 459 nm, 460 nm, 461 nm, 462 nm, 463 nm, 464 nm, 465 nm, 466 nm, 467 nm, 468 nm, 469 nm, 470 nm, 471 nm, 472 nm, 473 nm, 474 nm, 475 nm, 476 nm, 477 nm, 478 nm, 479 nm, 480 nm, 481 nm, 482 nm, 483 nm, 484 nm, 485 nm, 486 nm, 487 nm, 488 nm, 489 nm, 490 nm, 491 nm, 492 nm, 493 nm, 494 nm, 495 nm, 496 nm, 497 nm, 498 nm, 499 nm, 500 nm, 501 nm, 502 nm, 503 nm, 504 nm, 505 nm, 506 nm, 507 nm, 508 nm, 509 nm, 510 nm, 511 nm, 512 nm, 513 nm, 514 nm, 515 nm, 516 nm, 517 nm, 518 nm, 519 nm, 520 nm, 521 nm, 522 nm, 523 nm, 524 nm, 525 nm, 526 nm, 527 nm, 528 nm, 529 nm, 530 nm, 531 nm, 532 nm, 533 nm, 534 nm, 535 nm, 536 nm, 537 nm, 538 nm, 539 nm, 540 nm, 541 nm, 542 nm, 543 nm, 544 nm, 545 nm, 546 nm, 547 nm, 548 nm, 549 nm, or 550 nm, such that wavelengths below the baseline wavelength are minimized and/or blocked. The light barrier may also minimize and/or block wavelengths of visible light on the high end of the visible spectrum range between 550 nm and 700 nm, with the top-line wavelength set at a level equal to or greater than 550 nm such as 550 nm, 551 nm, 552 nm, 553 nm, 554 nm, 555 nm, 556 nm, 557 nm, 558 nm, 559 nm, 560 nm, 561 nm, 562 nm, 563 nm, 564 nm, 565 nm, 566 nm, 567 nm, 568 nm, 569 nm, 570 nm, 571 nm, 572 nm, 573 nm, 574 nm, 575 nm, 576 nm, 577 nm, 578 nm, 579 nm, 580 nm, 581 nm, 582 nm, 583 nm, 584 nm, 585 nm, 586 nm, 587 nm, 588 nm, 589 nm, 590 nm, 591 nm, 592 nm, 593 nm, 594 nm, 595 nm, 596 nm, 597 nm, 598 nm, 599 nm, 600 nm, 601 nm, 602 nm, 603 nm, 604 nm, 605 nm, 606 nm, 607 nm, 608 nm, 609 nm, 610 nm, 611 nm, 612 nm, 613 nm, 614 nm, 615 nm, 616 nm, 617 nm, 618 nm, 619 nm, 620 nm, 621 nm, 622 nm, 623 nm, 624 nm, 625 nm, 626 nm, 627 nm, 628 nm, 629 nm, 630 nm, 631 nm, 632 nm, 633 nm, 634 nm, 635 nm, 636 nm, 637 nm, 638 nm, 639 nm, 640 nm, 641 nm, 642 nm, 643 nm, 644 nm, 645 nm, 646 nm, 647 nm, 648 nm, 649 nm, 650 nm, 651 nm, 652 nm, 653 nm, 654 nm, 655 nm, 656 nm, 657 nm, 658 nm, 659 nm, 660 nm, 661 nm, 662 nm, 663 nm, 664 nm, 665 nm, 666 nm, 667 nm, 668 nm, 669 nm, 670 nm, 671 nm, 672 nm, 673 nm, 674 nm, 675 nm, 676 nm, 677 nm, 678 nm, 679 nm, 680 nm, 681 nm, 682 nm, 683 nm, 684 nm, 685 nm, 686 nm, 687 nm, 688 nm, 689 nm, 690 nm, 691 nm, 692 nm, 693 nm, 694 nm, 695 nm, 696 nm, 697 nm, 698 nm, 699 nm, or 700 nm, such that wavelengths above the top-line wavelength are minimized and/or blocked.

The amount of light blocked by the light barrier below the baseline or above the top-line may vary, but can be in a range from 50% to 100%, from 75% to 95%, from 80% to 90%, from 75% to 100%, or the like. In one embodiment, the amount of light blocked by the light barrier below the baseline or above the top-line is greater than 50% but less than or equal to 100%, greater than 51% but less than or equal to 100%, greater than 52% but less than or equal to 100%, greater than 53% but less than or equal to 100%, greater than 54% but less than or equal to 100%, greater than 55% but less than or equal to 100%, greater than 56% but less than or equal to 100%, greater than 57% but less than or equal to 100%, greater than 58% but less than or equal to 100%, greater than 59% but less than or equal to 100%, greater than 60% but less than or equal to 100%, greater than 61% but less than or equal to 100%, greater than 62% but less than or equal to 100%, greater than 63% but less than or equal to 100%, greater than 64% but less than or equal to 100%, greater than 65% but less than or equal to 100%, greater than 66% but less than or equal to 100%, greater than 67% but less than or equal to 100%, greater than 68% but less than or equal to 100%, greater than 69% but less than or equal to 100%, greater than 70% but less than or equal to 100%, greater than 71% but less than or equal to 100%, greater than 72% but less than or equal to 100%, greater than 73% but less than or equal to 100%, greater than 74% but less than or equal to 100%, greater than 75% but less than or equal to 100%, greater than 76% but less than or equal to 100%, greater than 77% but less than or equal to 100%, greater than 78% but less than or equal to 100%, greater than 79% but less than or equal to 100%, greater than 80% but less than or equal to 100%, greater than 81% but less than or equal to 100%, greater than 82% but less than or equal to 100%, greater than 83% but less than or equal to 100%, greater than 84% but less than or equal to 100%, greater than 85% but less than or equal to 100%, greater than 86% but less than or equal to 100%, greater than 87% but less than or equal to 100%, greater than 88% but less than or equal to 100%, greater than 89% but less than or equal to 100%, greater than 90% but less than or equal to 100%, greater than 91% but less than or equal to 100%, greater than 92% but less than or equal to 100%, greater than 93% but less than or equal to 100%, greater than 94% but less than or equal to 100%, greater than 95% but less than or equal to 100%, greater than 96% but less than or equal to 100%, greater than 97% but less than or equal to 100%, greater than 98% but less than or equal to 100%, or greater than 99% but less than or equal to 100%.

Light barriers within each of the package systems 10, 10*a*, 10*b*, 10*c* or 10*d* may include one or more coating layers, one or more additives within at least portions of the body 12 or the pouch body 42 of the package system 10, 10*a*, 10*b*, 10*c* or 10*d*, texturization of at least portions of the body 12 or the pouch body 42 of the package system 10, 10*a*, 10*b*, 10*c*, or 10*d* and/or combinations thereof as discussed in further detail below. The light barriers may be configured such that at least portions of the package system 10, 10*a* 10*b*, 10*c*, or 10*d* may be opaque, multi-color, single-color and/or translucent. Generally, the light barrier may be configured to minimize light transmission of visible light for wavelengths below the baseline wavelength and above the top-line wavelength to reduce or even eliminate the interaction between volatile compounds within the consumable product 22 and harmful wavelengths of visible light so as to maintain desirable organoleptic properties of the consumable product 22 (e.g., yogurt).

FIGS. 1A and 1B illustrate an exemplary embodiment of a light barrier that is integrated into the body 12 by using layering and/or coating techniques. In this example, the package system 10 includes one or more coating layers 62. Generally, the one or more coating layers 62 may be positioned on a portion of the body 12 that is semi-transparent, transparent and/or translucent and that may be devoid of any coloring. The coating layer 62 may be adhered to the body 12, attached to the body 12, be applied to the body 12, and/or be integrally formed within the body 12. For example, the one or more coating layer 62 may include a gloss coating applied to the body 12. In another example, the one or more coating layer 62 may include a colored coating applied to the body 12. In another example, the one or more coating layer 62 may include a rigid or flexible material attached to the body 12.

The one or more coating layer 62 may be positioned on the interior of the body 12, exterior of the body 12, or a combination of both. For example, FIG. 1B illustrates one coating layer 62 positioned on the exterior of the body 12, and in particular, the coating layers 62 are positioned on the exterior 30 of the side walls 16.

It should be noted that the coating layer 62 may be positioned on any portion of the body 12 including the bottom wall 14, side wall(s) 16, top wall 18, and/or the removable layer 40. For example, in some embodiments, the coating layer 62 may be positioned on the top wall 18 and/or the removable layer 40 such that light barrier protection may be provided to the consumable product 22 within the interior compartment 20 of the package system 10. Portions of, or the entire top wall 18 and/or the removable layer 40, may be formed of transparent and translucent material such that the consumable product 22 may be viewed through the coating layer 62 and the removable layer 40 and/or the top wall 18.

Figure 2A:
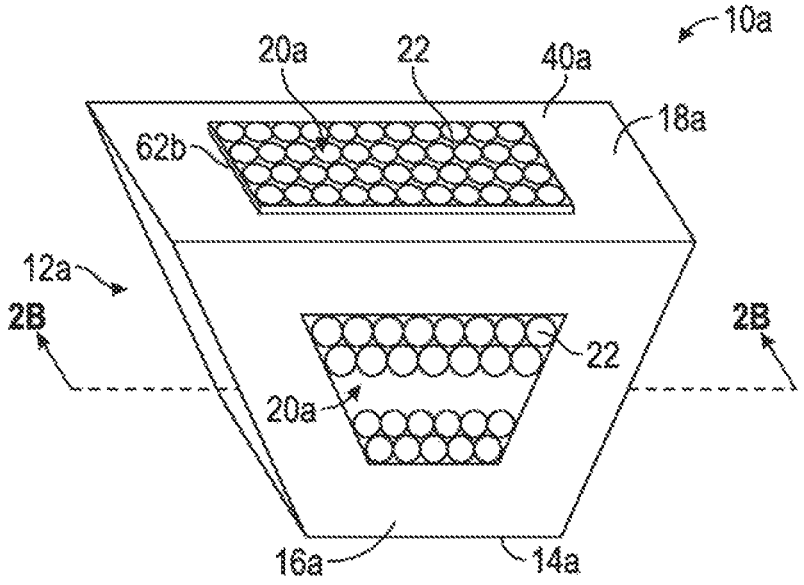
FIG. 2A is a perspective view of another exemplary embodiment of a package system in accordance with the present disclosure.
Figure 2B:
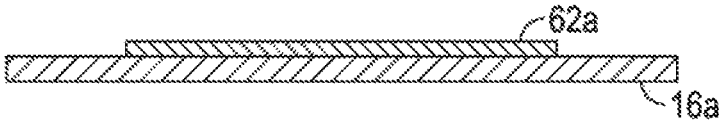
FIG. 2B is a cross sectional view taken along line 2B of FIG. 2A of an exemplary embodiment of an interior coating layer positioned on the sidewall of the package system.
Figure 2C:
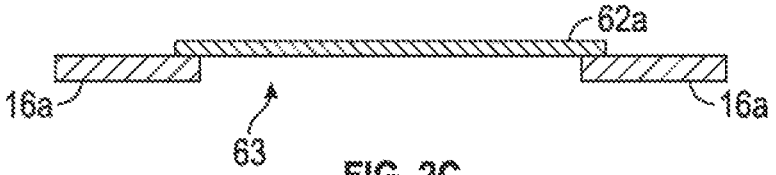
FIG. 2C is a cross sectional view of another exemplary embodiment of an interior coating layer positioned on the sidewall of the package system.

FIGS. 2A-2C illustrate a plurality of coating layers 62 positioned on the interior and exterior of the body 12*a*. In the example, the plurality of coating layers 62 are referred to hereinafter as a first coating layer 62*a* and a second coating layer 62*b*. By way of example, the first coating layer 62*a* is positioned on the interior of the body 12*a*, and in particular on the side wall 16*a*. The second coating layer 62*b* is positioned on the exterior of the body 12*a*, and in particular on the top wall 18*a*.

FIGS. 2B and 2C illustrate exemplary embodiments for positioning of the first coating layer 62*a*. Referring to FIGS. 2A and 2B, the portion of the body 12*a* adjacent to the first coating layer 62*a* may be semi-transparent, transparent and/or translucent such that the consumable product 22 may be visible from outside of the package system 10*a* through the side wall 16*a* and the first coating layer 62*a*. Referring to FIGS. 2A and 2C, a portion of the side wall 16*a* of the body 12*a* adjacent to the first coating layer 62*a* may define and surround a window 63. The first coating layer 62*a* covers the window 63, overlaps with the portion of the side wall 16*a* surrounding the window 63, and is attached to the side wall 16 such that the side wall 16 and the first coating layer 62*a* cooperate to contain the consumable product 22. The first coating layer 62*a* may be a filament, film, plastic, rigid material, flexible material, and/or the like configured to attach to the side wall 16*a*, for example. In this example, the side wall 16*a* may be constructed of a material, such as white plastic, that is opaque to visible light. The consumable product 22 may be visible from outside of the package system 10*a* through the first coating layer 62*a*.

Figure 6:
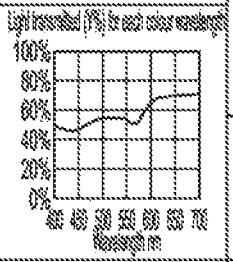
FIG. 6 is a tabular representation of filter properties and associated spectral profiles for use in light barriers in accordance with the present disclosure.
Figure 6:
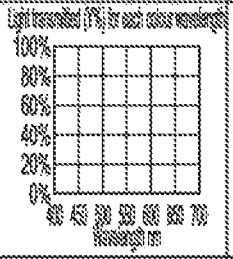
Figure 6:
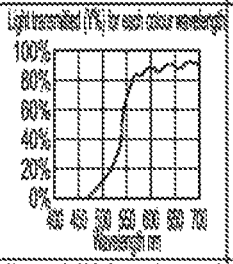
Figure 6:
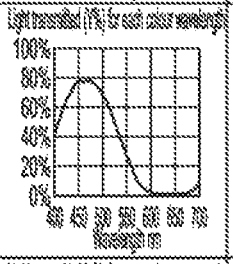
Figure 6:
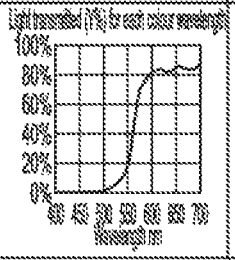
Figure 6:
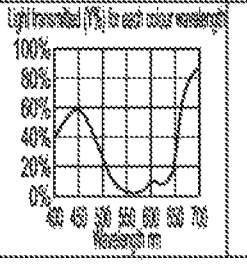

The coating layer 62 may be opaque, multi-color and/or translucent depending upon the wavelength of the visible light. Referring to FIGS. 1B and 6, the coating layer 62 may include one or more filtering properties 64. FIG. 6 illustrates exemplary filter properties 64 that may or may not be used in the coating layer 62 including exemplary spectral profiles 66. The filter properties 64 provide light barrier protection while maintaining visibility through the coating layer 62. In particular, the filtering properties 64 may provide light barrier protection at the baseline wavelength and/or top-line wavelength as described herein, while allowing for viewing of the consumable product 22. In one example, an orange filter having the spectral profile 66 shown in FIG. 6 may be used in the coating layer 62 of package system 10. The orange filter may provide light barrier protection below about 450 nm to prevent riboflavin decomposition of the consumable product 22 and provide approximately 0%-22% blocking of visible light having wavelengths below approximately 450 nm, for example. Further, the orange filter may also provide approximately 25%-85% blocking of visible light having wavelengths above approximately 600 nm. In some embodiments, one or more additional filtering properties 64 may be included within the coating layer 62.

Figure 3:
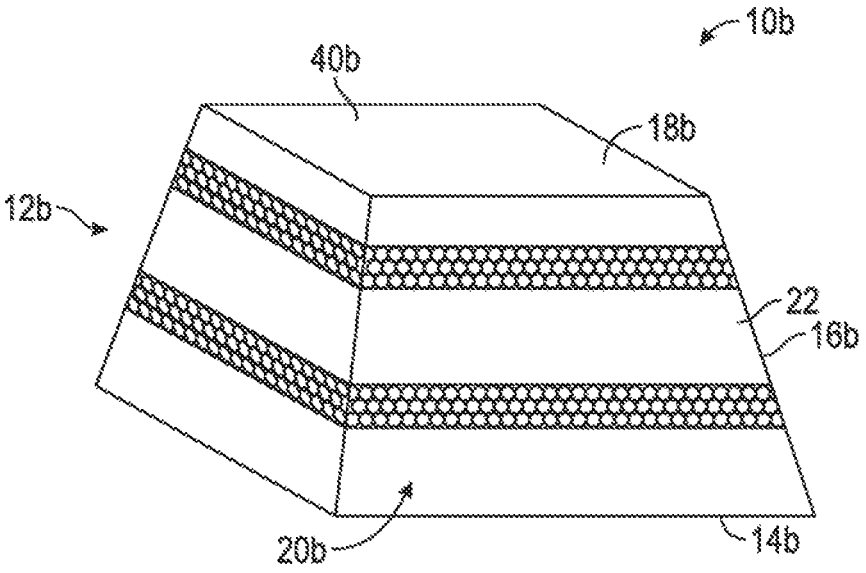
FIG. 3 is a perspective view of another exemplary embodiment of a package system in accordance with the present disclosure.
Figure 7:
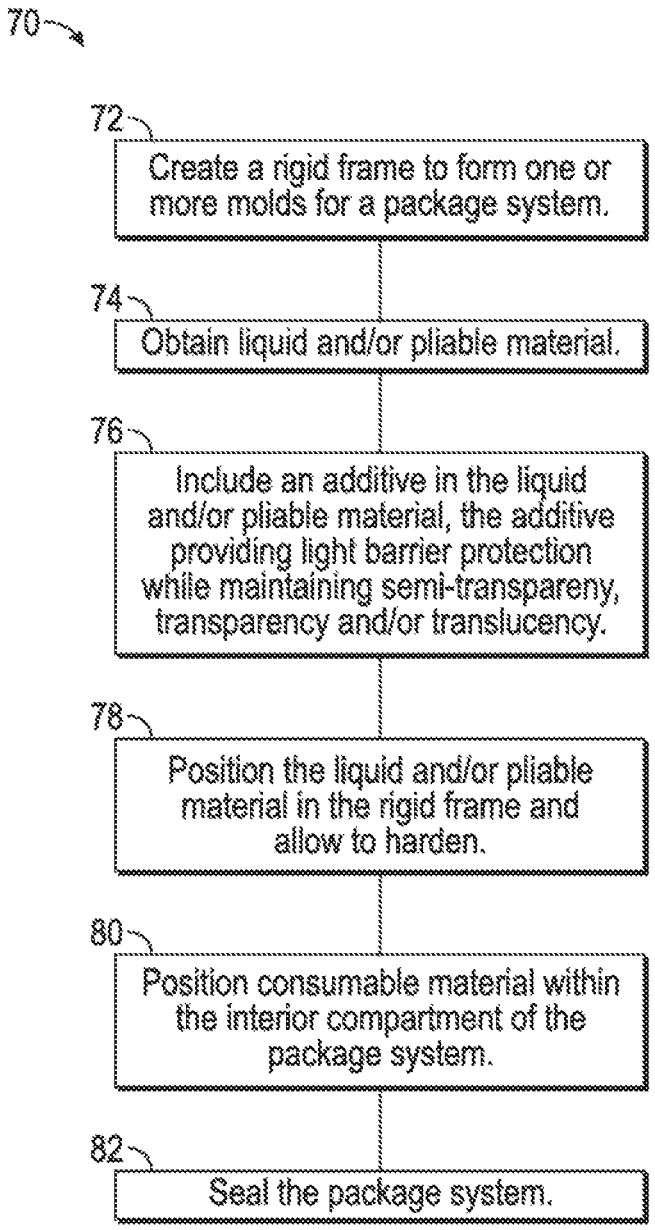
FIG. 7 is a flow chart of an exemplary method for forming a package system having a sidewall constructed with one or more additives with light barrier protection of a dairy product in accordance with the present disclosure.

In some embodiments, the light barrier may be provided via an additive included during formation of the package systems 10, 10*a*, 10*b*, 10*c* or 10*d*. FIG. 7 illustrates a flow chart 70 of an exemplary method for forming a package system, such as the package systems 10, 10*a*, 10*b*, 10*c* or 10*d*, having one or more additives that provide light barrier protection at the baseline wavelength and/or top-line wavelength for a portion or the entire package system 10, 10*a*, 10*b*, 10*c* or 10*d*, while allowing for viewing of the consumable product 22 from an exterior of the package system 10, 10*a*, 10*b*, 10*c* or 10*d*. For simplicity in description, the package system 10*b* of FIG. 3 is discussed in relation to formation of the package system 10*b* having an additive.

In a step 72, a rigid frame for the package system 10*b* may be created. The rigid frame may form a mold for the bottom wall 14*b*, side walls 16*b* and top wall 18*b*. In a step 74, a liquid and/or pliable material may be obtained.

In a step 76, one or more additives (e.g., resin additive) may be added to the liquid and/or pliable material. The additive(s) may include one or more filtering properties. For example, the additive(s) may provide one or more of the filtering properties shown in FIG. 6. In particular, the additive(s) may provide light barrier protection at the baseline wavelength and/or top-line wavelength for a portion of, or the entire package system 10*b* once formed, while allowing for viewing of the consumable product 22. To that end, the additive(s) may be added to a portion of the liquid and/or pliable material, or the entire liquid and/or pliable material.

In some embodiments, components of the package system 10*b* may be piece-molded and assembled such that multiple rigid frames may be used in the formation of the package system 10*b*. Additives may be added to one or more liquids and/or pliable materials placed in the one or more rigid frames.

In a step 78, the liquid and/or pliable material may be positioned in the rigid frame and may harden (e.g., may be cured). In a step 80, consumable product 22 may be positioned within the interior compartment 20*b* of the package system 10*b*. In a step 82, the top wall 18*b* may be applied to the side wall(s) 16*b* to seal the interior compartment 20*b*. Once sealed, the consumable product 22 may be visible from the outside of the package system 10*b*, however, the desirable organoleptic properties of the consumable product 22 (e.g., yogurt) may be maintained.

In some embodiments, the light barrier may be provided via texturization of a portion or the bodies 12, 12*a*, 12*b*, 12*c* or 12*d*. Texturizing the bodies 12, 12*a*, 12*b*, 12*c* or 12*d* causes the visible light to reflect, refract and/or be absorbed by the bodies 12, 12*a*, 12*b*, 12*c* or 12*d*. By selecting a texturization so as to block visible light below the baseline wavelength and above the top-line wavelength while passing wavelengths between the baseline wavelength and the top-line wavelength, the bodies 12, 12*a*, 12*b*, 12*c* or 12*d* protect the consumable product 22 while permitting a prospective purchaser to view the consumable product 22 through the bodies 12, 12*a*, 12*b*, 12*c* or 12*d*.

Figure 4A:
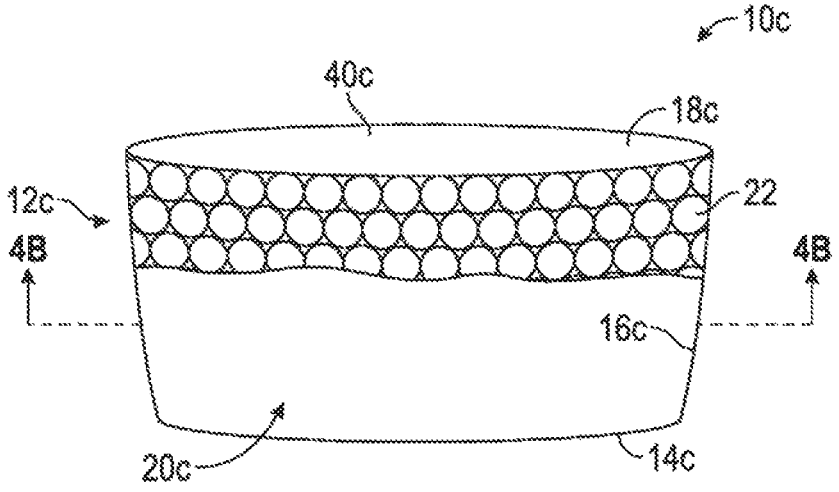
FIG. 4A is a perspective view of another exemplary embodiment of a package system in accordance with the present disclosure.
Figure 4B:
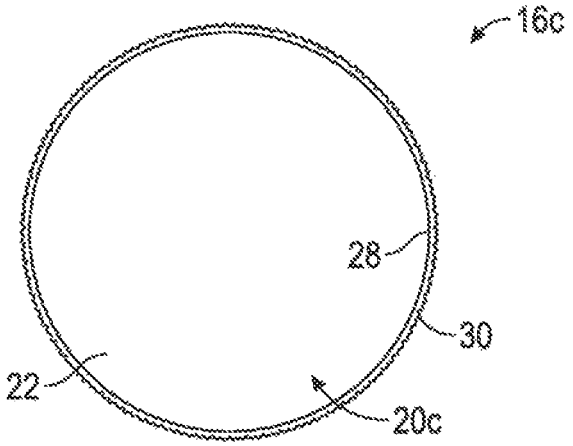
FIG. 4B is a cross sectional view of a side wall of the package system taken along line 4B-4B.
Figure 8:
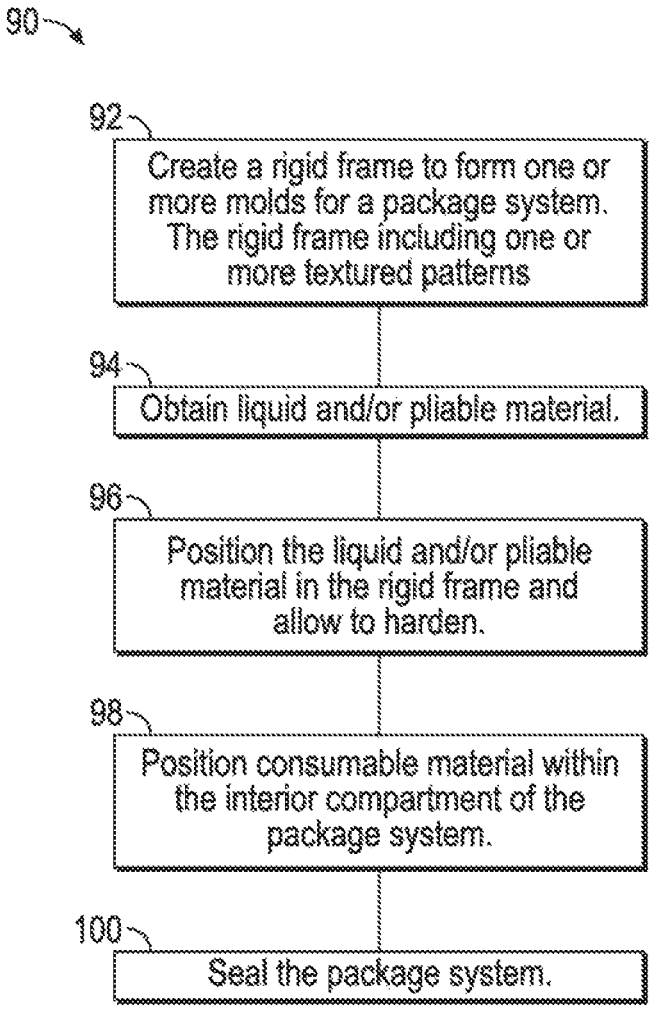
FIG. 8 is a flow chart of another exemplary method for forming a package system having a sidewall with one or more texturized portions that provide light barrier protection of the dairy product in accordance with the present disclosure.

FIG. 8 illustrates a flow chart 90 of an exemplary method for forming a package system, such as the exemplary package systems 10, 10*a*, 10*b* 10*c*, or 10*d*, having texturization of a portion of, or the entire package systems 10, 10*a*, 10*b*, 10*c* or 10*d*, providing light barrier protection at the baseline wavelength and/or top-line wavelength for a portion or the entire package system 10, 10*a*, 10*b*, 10*c*, or 10*d*, while allowing for viewing of the consumable product 22. For simplicity in description, the package system 10*c* of FIGS. 4A and 4B are discussed in relation to formation of the package system 10*c* having a texturized exterior surface 30 on the side wall 16*c*. It should be noted that any surface of the body 12*c* may be texturized to provide light barrier protection at the baseline wavelength and/or top-line wavelength while allowing for viewing of the consumable product 22

Figure 4C:
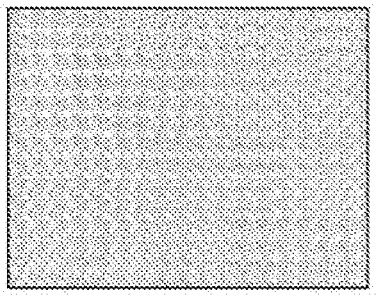
FIG. 4C is a photograph of an exemplary texture pattern for use in the package system of FIG. 4A.

In a step 92, a rigid frame for the package system 10*c* may be created. The rigid frame may be in a form of one or more molds for the bottom wall 14*c*, side wall 16*c*, and top wall 18*c*. In some embodiments, the rigid frame may include one or more portions having a textured pattern for one or more of the bottom wall 14*c*, side wall 16*c* and/or top wall 18*c*. FIG. 4C is a photograph of an exemplary texture pattern that may be used in accordance with the present disclosure. In some embodiments, the textured pattern may be provided for an exterior surface and/or an interior surface of one or more of the bottom wall 14*c*, side wall 16*c*, and/or top wall 18*c*. The textured pattern may be configured to deflect, absorb, and/or refract visible light when the package system 10*c* is formed.

In a step 94, a liquid and/or pliable material may be obtained. In a step 96, the liquid and/or pliable material may be positioned in the rigid frame and harden (e.g., cured). In a step 98, the consumable product 22 may be positioned within the interior compartment 20*c* of the package system 10*c*. In a step 100, the package system 10*c* may be sealed. Once sealed, the consumable product 22 may be visible from the outside of the package system 10*c*, however, the desirable organoleptic properties of the consumable product 22 (e.g., yogurt) may be maintained.

In some embodiments, texturization may be provided subsequent to formation of the package system 10*c*. For example, the package system 10*c* may be texturized using an etching technique (e.g., acid etching) such that a textured pattern is provided on the interior surface of the body 12*c*, exterior surface of the body 12*c* and/or both.

In some embodiments, the coating layer(s) 62 described in further detail herein in relation to FIGS. 1 and 2 may include one or more texturized portions. The texturized portions may be formed prior and/or subsequent to formation of the package systems 10 or 10*a*. In some embodiments, multiple coating layer 62 having similar or different texture patterns may be positioned adjacent to each other and configured to deflect and/or reflect light when positioned on the package system 10, 10*a*, 10*b*, 10*c*, or 10*d*. In some embodiments, the body 12 or pouch body 42 may be texturized, and additionally one or more coating layers 62 having similar or different texture patterns may be positioned adjacent to the texturized portion of the body 12 and configured to deflect and/or reflect light.

After the package system 10, 10*a*, 10*b*, 10*c* or 10*d* is formed, then such package system 10, 10*a*, 10*b*, 10*c* or 10*d* can be distributed to any suitable wholesale and/or retail outlet for presentation and sale. The wholesale and/or retail outlet will present the package system 10, 10*a*, 10*b*, 10*c* or 10*d* such that the consumable product 22 is displayed to a potential buyer through the viewing portion as described herein. Thus, the potential buyer will be able to see any fruit, layers or other features of the consumable product 22 prior to buying the package system 10, 10*a*, 10*b*, 10*c* or 10*d* containing the consumable product. The potential buyer will then obtain the package system 10, 10*a*, 10*b*, 10*c* or 10*d* having the consumable product 22 within the interior compartment 20, and remove the removable layer 40 or open the opening device 56 to provide access to the consumable product 22 so that the buyer may consume and enjoy the consumable product 22.

Thus, in accordance with the presently disclosed inventive concept(s), there has been provided a package system that fully satisfies the objectives set forth hereinabove. Although the presently disclosed inventive concept(s) has been described in conjunction with the specific language set forth hereinabove, it is evident that many alternatives, modifications, and variations will be apparent to those skilled in the art. Accordingly, it is intended to embrace all such alternatives, modifications, and variations that fall within the spirit and broad scope of the presently disclosed inventive concept(s). Changes may be made in the construction and the operation of the various components, elements, and assemblies described herein, as well as in the steps or the sequence of steps of the methods described herein, without departing from the spirit and scope of the presently disclosed inventive concept(s).

What is claimed is:

1. A package system, comprising:

a body having a bottom wall, at least one side wall, and a top wall cooperating with one another to define an interior compartment for housing a shelf-stable consumable product, wherein a portion of the at least one side wall defines and surrounds a window in the side wall;

at least one of the bottom wall, side wall, or top wall includes a viewing portion having a light barrier configured to block wavelengths of visible light from below a baseline wavelength and above a top-line wavelength and thus being a band-pass filter that allows visible light between the baseline wavelength and the top-line wavelength to pass through the viewing portion so as to allow the shelf-stable consumable product to be viewed through the viewing portion of the body, and wherein the baseline wavelength is selected from a range from 400 nm to 550 nm and wherein the top-line wavelength is selected from a second range from 550 nm to 700 nm; and wherein the viewing portion includes a coating layer as the light barrier, and wherein the coating layer covers the window, overlaps with the portion of the at least one side wall surrounding the window, and is attached to the side wall such that the side wall and the coating layer cooperate to contain the shelf-stable consumable product, and whereby the shelf-stable consumable product is visible from the outside of the package system through the coating layer.

2. The package system of claim 1, wherein the viewing portion includes the coating layer applied to at least one of the bottom wall, side wall, or top wall, wherein at least a portion of the body is formed of transparent material, and the coating layer is positioned adjacent to the transparent material and configured to allow the shelf-stable consumable product to be viewed through the body.

3. The package system of claim 2, wherein at least a portion of the coating layer includes a texturized pattern configured to deflect light.

4. The package system of claim 1, wherein the light barrier is an additive included during formation of the at least one of the bottom wall, side wall, or top wall.

5. The package system of claim 1, wherein the body includes an interior surface and an exterior surface, and wherein the light barrier is a textured pattern formed on at least one of the interior surface or exterior surface of the body.

6. A package system, comprising:

a shelf-stable consumable product; and a body having a bottom wall, at least one side wall, and a top wall cooperating with one another to define an interior compartment in which the shelf-stable consumable product is disposed, wherein a portion of the at least one side wall defines and surrounds a window in the side wall, at least one of the bottom wall, side wall or top wall including a viewing portion having a light barrier configured to block wavelengths of visible light from below a baseline wavelength and above a top-line wavelength and pass visible light between the baseline wavelength and the top-line wavelength so as to allow the shelf-stable consumable product to be viewed through the viewing portion of the body wherein the baseline wavelength is selected from a range from 400 nm to 550 nm and wherein the top-line wavelength is selected from a second range from 550 nm to 700 nm, and wherein the viewing portion includes a coating layer as the light barrier, and wherein the coating layer covers the window, overlaps with the portion of the at least one side wall surrounding the window, and is attached to the side wall such that the side wall and the coating layer cooperate to contain the shelf-stable consumable product, and whereby the shelf-stable consumable product is visible from the outside of the package system through the coating layer.

7. The package system of claim 6, wherein the shelf-stable consumable product is a dairy product.

8. The package system of claim 7, wherein the shelf-stable consumable product includes at least one layer of yogurt and at least one layer of a non-yogurt product.

9. The package system of claim 8, wherein the non-yogurt product is selected from a group consisting of a fruit-based product, granola, cereal, nuts, seeds, spices, and combinations thereof.

10. The package system of claim 6, wherein the shelf-stable consumable product is a traditionally non-dairy product that can benefit from the packaged system.

11. A method for making a package system, comprising the steps of:

forming a body having a bottom wall, and one or more sidewall partially surrounding an interior compartment, a portion of the side wall defining and surrounding a window in the side wall, at least one of the bottom wall or sidewall having a viewing portion, the viewing portion includes a coating layer being a band-pass filter to minimize wavelengths of visible light below a baseline wavelength and above a top-line wavelength from passing through the viewing portion while allowing visible light between the baseline wavelength and the top-line wavelength to pass through the viewing portion, the coating layer covering the window, overlapping with the portion of the side wall surrounding the window, and being attached to the side wall such that the side wall and the coating layer cooperate to contain the shelf-stable consumable product, and whereby the shelf-stable consumable product is visible from the outside of the package system through the coating layer;

disposing a shelf-stable dairy product into the interior compartment; and sealing the interior compartment such that when the body is exposed to visible light, the shelf-stable dairy product is viewable through the viewing portion, wherein the baseline wavelength is selected from a first range from 400 nm to 550 nm and the top-line wavelength is selected from a second range from 550 nm to 700 nm.

12. The method of claim 11, wherein the shelf-stable dairy product is yogurt.

13. The method of claim 11, wherein the shelf-stable dairy product includes at least one layer of yogurt and at least one layer of a non-yogurt product.

14. The method of claim 11, wherein the shelf-stable dairy product is a traditionally non-dairy product that can benefit from the packaged system.

15. A method, comprising the steps of:

obtaining a package system having a shelf-stable dairy product within an interior compartment of a body, the body having one or more sidewall partially surrounding the interior compartment, wherein a portion of the side wall defines and surrounds a window in the side wall, and a removable layer partially surrounding the interior compartment and sealingly connected to the one or more sidewall, the sidewall having a viewing portion that includes a coating layer being a band-pass filter to minimize wavelengths of visible light below a baseline wavelength and above a top-line wavelength from passing through the viewing portion while allowing visible light between the baseline wavelength and the top-line wavelength to pass through the viewing portion, wherein the baseline wavelength is selected from a first range from 400 nm to 550 nm and the top-line wavelength is selected from a second range from 550 nm to 700 nm, the coating layer covering the window, overlapping with the portion of the side wall surrounding the window, and being attached to the side wall such that the side wall and the coating layer cooperate to contain the shelf-stable dairy product, and whereby the shelf-stable consumable product is visible from the outside of the package system through the coating layer; and removing the removable layer from the body to provide access to the shelf-stable dairy product.

16. The method of claim 15, wherein the shelf-stable dairy product is yogurt.

17. The method of claim 15, wherein the shelf-stable dairy product includes at least one layer of yogurt and at least one layer of a non-yogurt product.

18. The method of claim 15, wherein the shelf-stable dairy product is a traditionally non-dairy product that can benefit from the packaged system.

19. The method of claim 15, wherein the package system is selected from a group consisting of those as claimed in any one of claim 1 to claim 10.

20. The method of claim 15, wherein the package system is made by the method selected from a group consisting of those as claimed in any one of claim 11 to claim 14.

* * * * *